US007069828B2

(12) United States Patent
Huang

(10) Patent No.: US 7,069,828 B2
(45) Date of Patent: Jul. 4, 2006

(54) TOOL HAVING ADJUSTABLE HANDLE

(76) Inventor: Yung Hsu Huang, P.O.Box 63-298, Taichung 40699 (TW)

( * ) Notice: Subject to any disclaimer, the term of this patent is extended or adjusted under 35 U.S.C. 154(b) by 0 days.

(21) Appl. No.: 11/091,689

(22) Filed: Mar. 29, 2005

(65) Prior Publication Data

US 2006/0016302 A1 Jan. 26, 2006

Related U.S. Application Data

(63) Continuation-in-part of application No. 10/896,447, filed on Jul. 23, 2004.

(51) Int. Cl.
*B25B 23/16* (2006.01)
*B25G 1/08* (2006.01)

(52) U.S. Cl. ..... 81/489; 81/177.4
(58) Field of Classification Search ..... 81/489, 81/177.1, 177.4, 490, 439, 58, 58.1
See application file for complete search history.

(56) References Cited

U.S. PATENT DOCUMENTS

| | | | | |
|---|---|---|---|---|
| 4,227,430 | A * | 10/1980 | Jansson et al. | 81/177.4 |
| 5,499,562 | A * | 3/1996 | Feng | 81/177.4 |
| 5,868,048 | A * | 2/1999 | Cassutti et al. | 81/439 |
| 5,899,127 | A * | 5/1999 | Shiao | 81/490 |
| 6,298,755 | B1 * | 10/2001 | England | 81/438 |
| 2006/0016302 | A1 * | 1/2006 | Huang | 81/489 |

* cited by examiner

*Primary Examiner*—Lee D. Wilson

(57) ABSTRACT

A tool includes a handle device having a shank for driving tool members, and having a primary hand grip. An auxiliary hand grip is selectively attached to the primary hand grip, to increase a length of the tool by combining both the auxiliary hand grip and the primary hand grip together, and the auxiliary hand grip may be selectively detached from the barrel of the handle device, to decrease the length of the tool to only the primary hand grip. A tool device may further be received in the auxiliary hand grip, and removable from the auxiliary hand grip, for driving tool elements having a dimension smaller than that of the tool members. A casing may be secured to the auxiliary hand grip, to receive a tape measuring device.

9 Claims, 5 Drawing Sheets

TOOL HAVING ADJUSTABLE HANDLE

The present invention is a continuation-in-part of U.S. patent application Ser. No. 10/896,447, filed on 23 Jul. 2004, pending.

BACKGROUND OF THE INVENTION

1. Field of the Invention

The present invention relates to a tool, and more particularly to a tool having an adjustable handle which is adjustable to different length.

2. Description of the Prior Art

Typical tool handles, such as tool handles for screw drivers, comprise a driving shank attached or secured to a hand grip, for allowing the driving shank to be rotated or driven by the hand grip. Normally, the hand grip of the typical tool handles comprise a predetermined length that may not be adjusted to different lengths, and thus may not be suitably rotated or driven by palms of users of different sizes or areas.

For example, U.S. Pat. No. 5,601,003 to Amtenbrink et al. discloses one of the typical tool handles comprise a hand grip also having a predetermined length that may not be adjusted to different lengths, such that the typical tool handle also may not be suitably rotated or driven by palms of users of different sizes or areas or dimensions.

U.S. Pat. No. 6,070,273 to Shiao discloses another typical tool handle comprising a hand grip having a cavity formed therein for receiving a ratchet driving mechanism therein. Similarly, the tool handle also includes a predetermined length that may not be adjusted to different lengths, such that the typical tool handle also may not be suitably rotated or driven by palms of users of different sizes or areas.

The present invention has arisen to mitigate and/or obviate the afore-described disadvantages of the conventional tool handles.

SUMMARY OF THE INVENTION

The primary objective of the present invention is to provide a tool including an adjustable handle which is adjustable to different length.

The other objective of the present invention is to provide a tool including another driving tool disposed or engaged in the handle thereof, for rotating or driving fasteners of smaller sizes or diameters or dimensions.

The further objective of the present invention is to provide a tool including a tape disposed or engaged in the handle for length measuring purposes.

In accordance with one aspect of the invention, there is provided a tool comprising a handle device including a shank extended forwardly therefrom, for engaging with and for driving tool members, and including a primary hand grip provided thereon and having a space formed therein, an auxiliary hand grip including a protrusion extended therefrom, and selectively engageable into the space of the primary hand grip, to selectively attach the auxiliary hand grip to the primary hand grip of the handle device, and to increase a length of the tool by combining both the auxiliary hand grip and the primary hand grip together, and the auxiliary hand grip being selectively detachable from the primary hand grip of the handle device, to decrease the length of the tool to only the primary hand grip, and the auxiliary hand grip including a chamber formed therein, and a tool device received in the chamber of the auxiliary hand grip, and removable from the auxiliary hand grip, for driving tool elements having a dimension smaller than that of the tool members.

The auxiliary hand grip includes a tool holder received in the chamber thereof, and includes a cover attached thereto, to enclose the chamber thereof, and to stably retain the tool holder in the chamber of the auxiliary hand grip. The tool holder includes a plurality of orifices formed therein, for receiving the tool members therein.

The tool holder includes a plurality of slits formed therein, and communicating with the orifices thereof, to resiliently clamping and retaining the tool members to the tool holder. The tool holder includes a bore formed therein, the tool device includes a driving stem received in the bore of the tool holder.

The tool device includes a driving stem having a chamber formed therein to receive the tool elements therein. The driving stem includes an cap attached thereto, to enclose the chamber thereof and to stably retain the tool elements within the chamber thereof.

The auxiliary hand grip includes a cavity formed in the cover and defined by a peripheral fence, the driving stem includes an enlarged head formed on the end cap and engaged in or seated within the cavity of the cover.

The driving stem includes an orifice formed therein and defined between at least two spring blades, for receiving either of the tool elements therein, and a control ferrule threaded onto the driving stem, for selectively forcing the spring blades toward each other, in order to detachably clamp and secure the tool element to the driving stem, and to allow the tool element to be rotated or driven by the driving stem.

The auxiliary hand grip includes a casing secured to the cover and having an opening formed therein, and includes a tape measuring device received in the casing and having a tape, the tape includes a free end portion engageable through the opening of the casing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
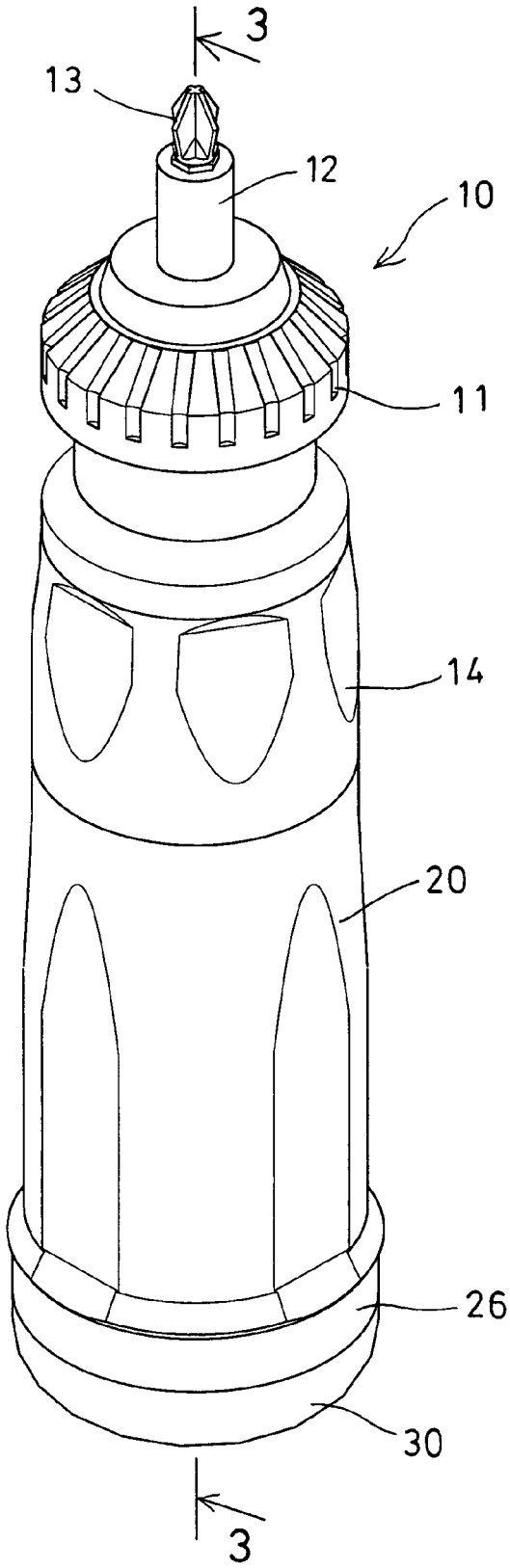
FIG. 1 is a perspective view of a tool handle in accordance with the present invention.
Figure 2:
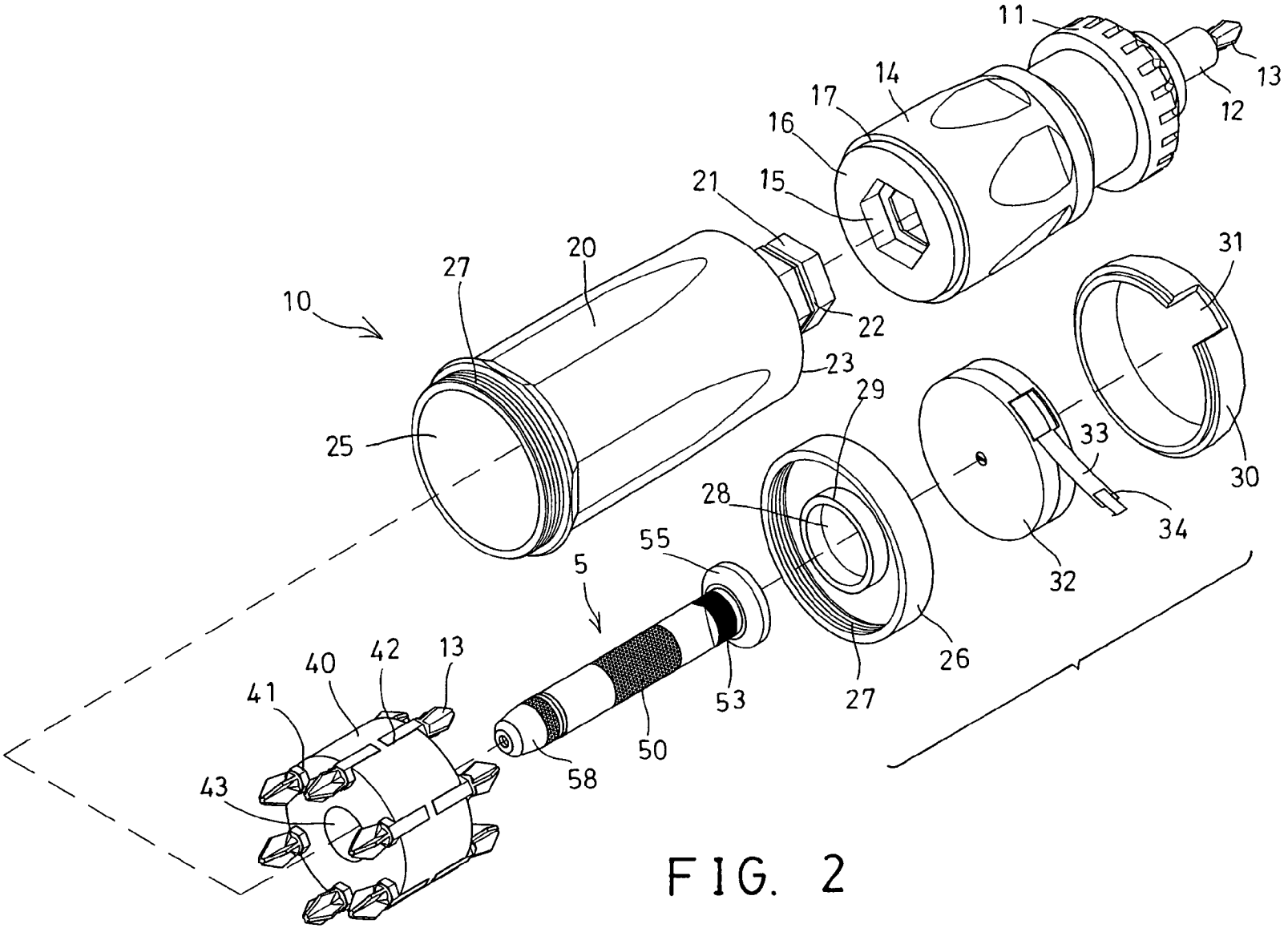
FIG. 2 is an exploded view of the tool handle.
Figure 3:
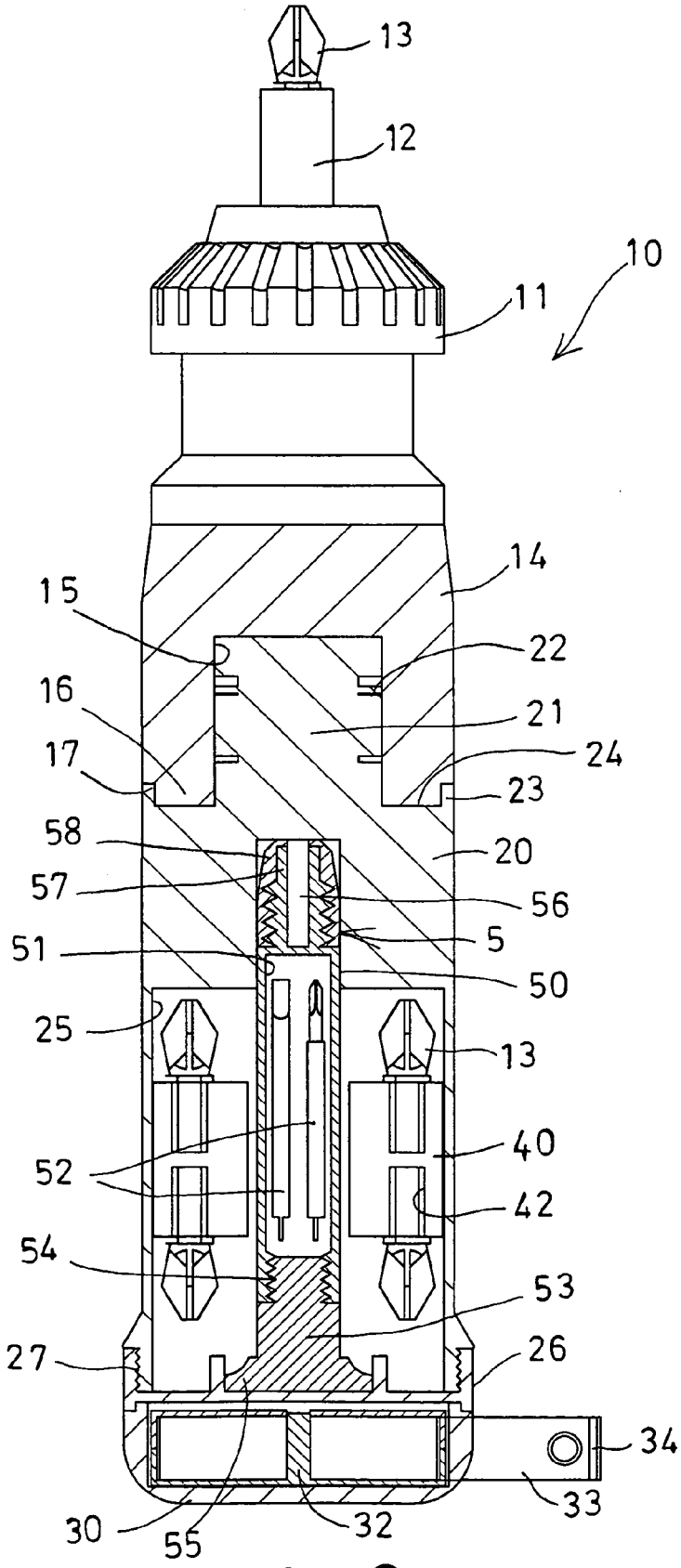
FIG. 3 is a cross sectional view of the tool handle, taken along lines 3—3 of FIG. 1.

Referring to the drawings, and initially to FIGS. 1–3, a tool 10 in accordance with the present invention comprises a handle device 11 including a shank 12 extended forwardly therefrom, for engaging with or for attaching a tool member 13 thereto, such as a screw driver bit 13, a tool extension (not shown), or the like. The handle device 11 may include a ratchet driving mechanism disposed therein (not shown), for driving the tool member 13 in an active direction, and for allowing the tool member 13 to be rotated freely relative to the handle portion or the handle device 11 in a reverse direction.

The handle device 11 includes a base or primary handle section or hand grip 14 having a space 15 formed therein, and having a non-circular cross section, and having an annular or peripheral flange 16 extended rearwardly therefrom, and having an outer diameter smaller than that of the primary hand grip 14, to form a peripheral shoulder 17 between the peripheral flange 16 and the primary hand grip 14. It is preferable, but not necessarily, that the primary hand grip 14 is made of transparent or semi-transparent materials.

An auxiliary handle section or hand grip 20 includes a protrusion 21 extended therefrom, and engageable into the space 15 of the base or primary handle section or hand grip 14, and having a non-circular cross section corresponding to that of the space 15 of the base or primary handle section or hand grip 14, to allow the auxiliary hand grip 20 to be solidly attached to the handle device 11, and to prevent the auxiliary hand grip 20 from being rotated relative to the handle device 11.

A spring member 22 may be attached to or provided on the protrusion 21 (FIG. 3), for engaging with and for stably or solidly securing the auxiliary hand grip 20 to the handle device 11. The auxiliary hand grip 20 further includes an outer peripheral fence 23 extended therefrom, and arranged or located around the protrusion 21, to form or define a peripheral recess 24 between the outer peripheral fence 23 and the protrusion 21, and to receive the peripheral flange 16 of the primary hand grip 14, and thus to further stably anchor or secure the auxiliary hand grip 20 to the primary hand grip 14 of the handle device 11.

Figure 4:
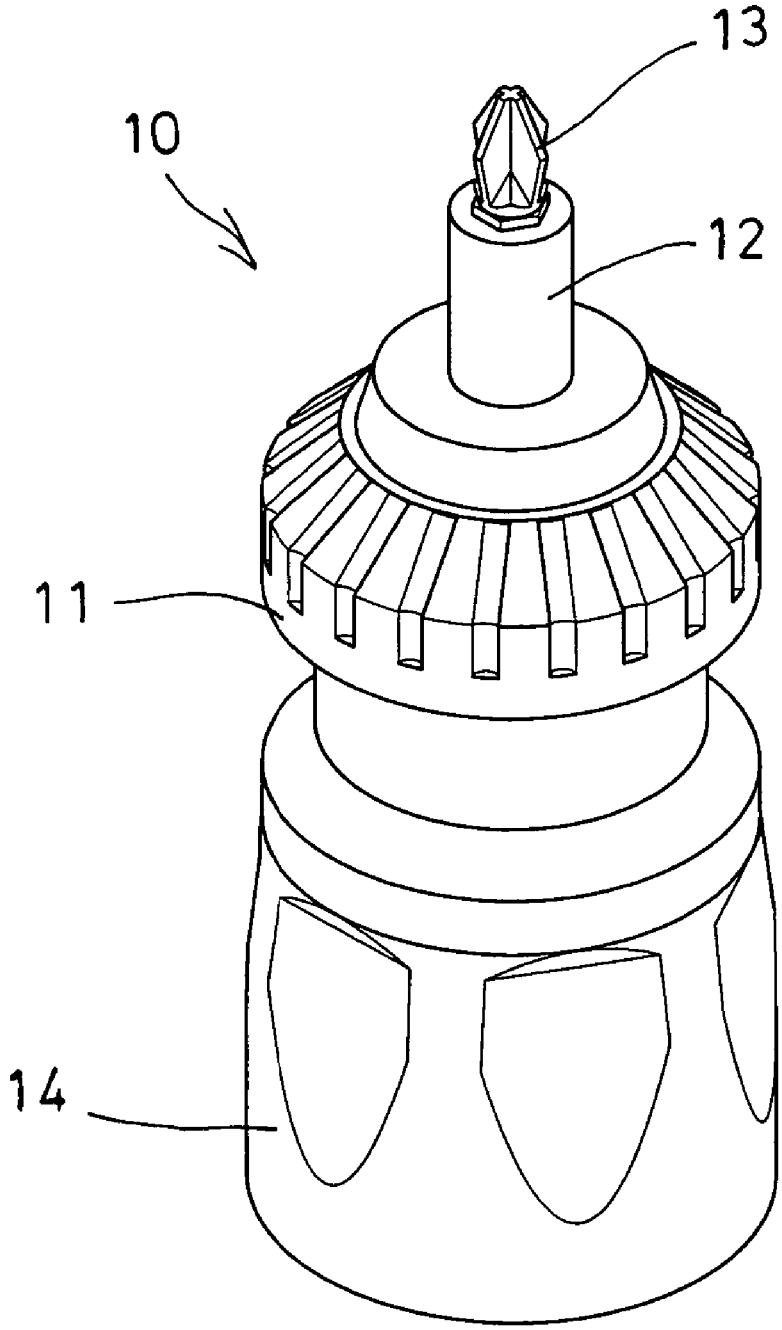
FIG. 4 is a perspective view illustrating the operation of the tool handle, having an auxiliary hand grip removed or detached from a base or primary hand grip.
Figure 5:
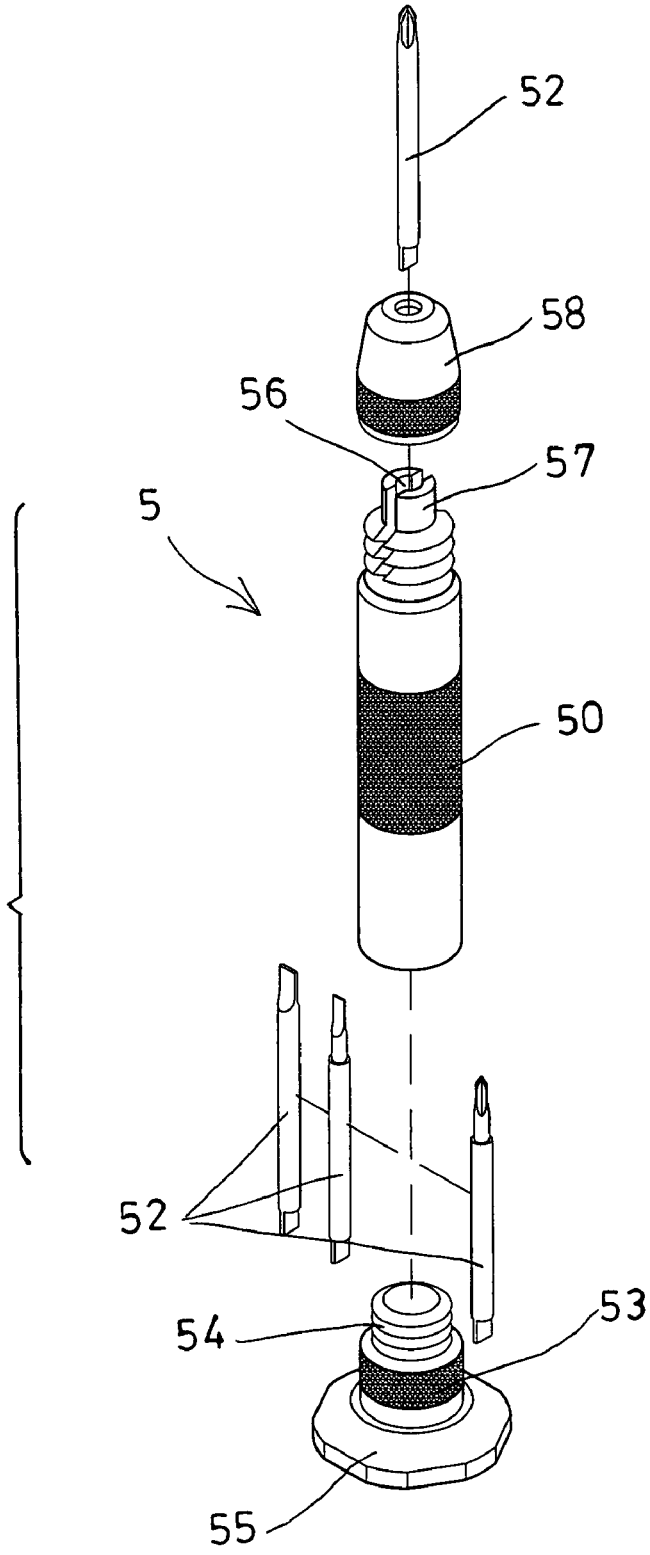
FIG. 5 is a partial exploded view illustrating another driving tool to be disposed and engaged into the handle of the tool, for rotating or driving fasteners of smaller sizes or diameters or dimensions.

In operation, as shown in FIGS. 1 and 3, the auxiliary hand grip 20 may be selectively attached or secured to the primary hand grip 14 of the handle device 11, to allow the tool 10 to have an increased length combined by both the auxiliary hand grip 20 and the primary hand grip 14. As shown in FIG. 4, the auxiliary hand grip 20 may also be detached or disengaged from the primary hand grip 14, to reduce the length of the tool 10 to only the primary hand grip 14.

Accordingly, the tool 10 may include a longer length combined by both the auxiliary hand grip 20 and the primary hand grip 14, or a shorter length of only the primary hand grip 14, to allow the tool 10 to be suitably grasped or held by palms of users having different sizes or areas, and to allow the tool 10 to be suitably rotated or driven by the users in different working environments.

The auxiliary hand grip 20 further includes a chamber 25 formed therein, to receive a tool holder 40 therein, and a cover 26 attachable to the auxiliary hand grip 20 with such as a threading engagement 27, in order to enclose the chamber 25 thereof, and to stably retain the tool holder 40 within the chamber 25 thereof, and to prevent the tool holder 40 from being disengaged from the auxiliary hand grip 20. The cover 26 includes a cavity 28 formed therein and defined by a peripheral fence 29.

A casing 30 may further be provided and secured to the cover 26, to receive a tape measuring device 32 therein, and includes an opening 31 formed therein, for receiving a free end portion 34 of a tape 33 of the tape measuring device 32 therein, to allow the tape 33 to be pulled out of the casing 30 to conducting measuring operations. The casing 30 may be solidly secured to the cover 26 with such as fasteners or latches (not shown), or by adhesive materials, by welding processes, etc.

The tool holder 40 includes a number of orifices 41 formed therein (FIG. 2) for receiving the tool members 13, such as the screw driver bits 13, the tool extensions, or the like, and includes a number of slits 42 formed therein and communicating with the orifices 41 thereof, for resiliently clamping or retaining the tool members 13 to the tool holder 40. The tool holder 40 may further include a bore 43 formed therein, to receive a driving stem 50 of another tool device 5 therein.

The tool device 5 includes a chamber 51 formed in the driving stem 50 to receive one or more tool elements 52 therein, an end cap 53 attached to a rear end of the driving stem 50 with such as a threading engagement 54, in order to enclose the chamber 51 of the driving stem 50, and to stably retain the tool elements 52 within the chamber 51 of the driving stem 50. The driving stem 50 may include an enlarged head 55 formed on the end cap 53 and engaged in or seated within the cavity 28 that is formed and defined within the peripheral fence 29 of the cover 26, best shown in FIG. 3.

The driving stem 50 may include an orifice 56 formed in the front portion thereof and defined between two or more spring blades 57, for receiving either of the tool elements 52 therein, and a control ferrule 58 threaded onto the driving stem 50, for selectively forcing the spring blades 57 toward each other, in order to detachably clamp or secure the tool elements 52 to the driving stem 50, and to allow the tool elements 52 to be rotated or driven by the driving stem 50. The tool elements 52 include a size or diameter or dimension smaller than that of the tool members 13, for engaging with and for driving fasteners of relatively smaller sizes or diameters or dimensions.

Accordingly, the tool in accordance with the present invention includes an adjustable structure for allowing the tool to be adjusted to different length, and includes another driving tool disposed or engaged in the handle thereof, for rotating or driving fasteners of smaller sizes or diameters or dimensions, and includes a tape disposed or engaged in the handle for length measuring purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a handle device including a shank extended forwardly therefrom, for engaging with and for driving tool members, and including a primary hand grip provided thereon and having a space formed therein, an auxiliary handgrip including a protrusion extended therefrom, and selectively engageable into said space of said primary hand grip, to selectively attach said auxiliary hand grip to said primary hand grip of said handle device, and to increase a length of said tool by combining both said auxiliary hand grip and said primary hand grip together, and said auxiliary hand grip being selectively detachable from said primary hand grip of said handle device, to decrease the length of said tool to only said primary hand grip, and said auxiliary hand grip including a chamber formed therein, a cover attached to said auxiliary hand grip to enclose said chamber of said auxiliary hand grip, a casing secured to said cover, said casing including an opening formed therein, a tape measuring device received in said casing and having a tape, said tape including a free end portion engageable through said opening of said casing, and a tool device received in said chamber of said auxiliary hand grip, and removable from said auxiliary hand grip, for driving tool elements having a dimension smaller than that of said tool members.

2. The tool as claimed in claim 1, wherein said tool device includes a driving stem having a chamber formed therein to receive said tool elements therein.

3. The tool as claimed in claim 2, wherein said driving stem includes an cap attached thereto, to enclose said chamber thereof and to stably retain said tool elements within said chamber thereof.

4. A tool comprising:

a handle device including a shank extended forwardly therefrom, for engaging with and for driving tool members, and including a primary hand grip provided thereon and having a space formed therein, an auxiliary hand grip including a protrusion extended therefrom, and selectively engageable into said space of said primary hand grip, to selectively attach said auxiliary hand grip to said primary hand grip of said handle device, and to increase a length of said tool by combining both said auxiliary hand grip and said primary hand grip together, and said auxiliary hand grip being selectively detachable from said primary hand grip of said handle device, to decrease the length of said tool to only said primary hand grip, and said auxiliary hand grip including a chamber formed therein, and a tool device received in said chamber of said auxiliary hand grip, and removable from said auxiliary hand grip, for driving tool elements having a dimension smaller than that of said tool members, and said auxiliary hand grip a tool holder received in said chamber thereof, and including a cover attached thereto, to enclose said chamber thereof and to stably retain said tool holder in said chamber of said auxiliary hand grip.

5. The tool as claimed in claim 4, wherein said tool holder includes a plurality of orifices formed therein, for receiving said tool members therein.

6. The tool as claimed in claim 5, wherein said tool holder includes a plurality of slits formed therein, and communicating with said orifices thereof, to resiliently clamping and retaining said tool members to said tool holder.

7. The tool as claimed in claim 4, wherein said tool holder includes a bore formed therein, said tool device includes a driving stem received in said bore of said tool holder.

8. A tool comprising:

a handle device including a shank extended forwardly therefrom, for engaging with and for driving tool members, and including a primary hand grip provided thereon and having a space formed therein, an auxiliary hand grip including a protrusion extended therefrom, and selectively engageable into said space of said primary hand grip, to selectively attach said auxiliary hand grip to said primary hand grip of said handle device, and to increase a length of said tool by combining both said auxiliary hand grip and said primary hand grip together, and said auxiliary hand grip being selectively detachable from said primary hand grip of said handle device, to decrease the length of said tool to only said primary hand grip, and said auxiliary hand grip including a chamber formed therein, and a tool device received in said chamber of said auxiliary hand grip, and removable from said auxiliary hand grip, for driving tool elements having a dimension smaller than that of said tool members, said tool device including a driving stem having a chamber formed therein to receive said tool elements therein, said driving stem including a cap attached thereto, to enclose said chamber thereof and to stably retain said tool elements within said chambers thereof, and said auxiliary hand grip including a cover attached thereto, to enclose said chamber thereof, and having a cavity formed therein and defined by a peripheral fence, said driving stem including an enlarged head formed on said end cap and engaged in or reseated within said cavity of said cover.

9. A tool comprising:

a handle device including a shank extended forwardly therefrom, for engaging with and for driving tool members, and including a primary hand grip provided thereon and having a space formed therein, an auxiliary hand grip including a protrusion extended therefrom, and selectively engageable into said space of said primary hand grip, to selectively attach said auxiliary hand grip to said primary hand grip of said handle device, and to increase a length of said tool by combining both said auxiliary hand grip and said primary hand grip together, and said auxiliary hand grip being selectively detachable from said primary hand grip of said handle device, to decrease the length of said tool to only said primary hand grip, and said auxiliary hand grip including a chamber formed therein, and a tool device received in said chamber of said auxiliary hand grip, and removable from said auxiliary hand grip, for driving tool elements having a dimension smaller than that of said tool members, said tool device including a driving stem having a chamber formed therein to receive said tool elements therein, and said driving stem including an orifice formed therein and defined between at least two spring blades, for receiving either of said tool elements therein, and a control ferrule threaded onto said driving stem, for selectively forcing said spring blades toward each other, in order to detachably clamp and secure said tool element to said driving stem, and to allow said tool element to be rotated or driven by said driving stem.

* * * * *